US005816739A

United States Patent [19]

Allen

[11] Patent Number: 5,816,739

[45] Date of Patent: Oct. 6, 1998

[54] HIGH PERFORMANCE TRIPLE ROTOR RIDING TROWEL

[75] Inventor: J. Dewayne Allen, Paragould, Ark.

[73] Assignee: Allen Engineering Corp., Paragould, Ark.

[21] Appl. No.: 781,656

[22] Filed: Jan. 10, 1997

[51] Int. Cl.[6] ..... E01C 19/22

[52] U.S. Cl. ..... 404/112; 451/353

[58] Field of Search ..... 404/75, 96, 112, 404/118; 451/353

[56] References Cited

U.S. PATENT DOCUMENTS

| | | | |
|---|---|---|---|
| 3,412,657 | 11/1968 | Colizza et al. | 94/45 |
| 3,936,212 | 2/1976 | Holz, Sr. et al. | 404/112 |
| 4,046,484 | 9/1977 | Holz, Sr. et al. | 404/112 |
| 5,108,220 | 4/1992 | Allen et al. | 404/112 |
| 5,480,257 | 1/1996 | Allen | 404/112 |
| 5,480,258 | 1/1996 | Allen | 404/112 |

*Primary Examiner*—James Lisehora

*Attorney, Agent, or Firm*—Stephen D. Carver

[57] ABSTRACT

A high performance, three engine, three rotor riding trowel for finishing concrete. A rigid, generally triangular frame mounts three downwardly projecting, bladed rotors that frictionally engage the concrete surface therebelow. The rotors on opposite sides of the operator (i.e., to the left or right) rotate in opposite directions, and they are tilted in coincident pivot planes that are parallel with the frame rear. The front rotor is titled in a plane that is perpendicular to the pivoting plane of the other two rotors. Tilting of the rotors with double acting hydraulic cylinders effectuates steering of the apparatus. Joy sticks enable the operator to hand control the trowel with minimal physical exertion. A unique hydraulic powered linkage generates steering forces by tilting the rotors in response to electrical signals. The gearboxes are interchangeable and mounted to tiltable, steering boxes secured to the frame. Each rotor establishes a generally vertical axis of rotation. Several equidistantly spaced blades extend radially outward from each rotor. The blades contact plastic concrete to finish the surface while supporting the trowel.

20 Claims, 15 Drawing Sheets

HIGH PERFORMANCE TRIPLE ROTOR RIDING TROWEL

BACKGROUND OF THE INVENTION

1. Field of the Invention

This invention relates to motorized riding trowels for finishing concrete surfaces. More particularly, the present invention relates to high powered, multi-engine riding trowels propelled by multiple, downwardly projecting, tiltable rotors that contact the concrete. Representative prior art self-propelled riding trowels are classified in United States Patent Class 404, Subclass 112.

2. Description of the Prior Art

Self-propelled, motorized riding trowels have become widely accepted in the concrete finishing arts. High-power, multiple engine riding trowels are particularly effective. They can finish large surface areas of wet concrete much more efficiently than single engine riding trowels or the older "walk behind" trowels. Significant savings are experienced by the contractor using such equipment, as time constraints and labor expenses are reduced.

Typical motorized riding trowels employ multiple, downwardly projecting rotors. The rotors contact the concrete surface for finishing concrete and support the weight of the trowel. Typically each rotor comprises a plurality of radially spaced apart finishing blades that revolve in frictional contact with the concrete surface. The blades may be coupled to circular finishing pans for treating green concrete. The rotors and their revolving blades are responsible for steering and propulsion. To effectuate steering the rotors are tilted to generate differential forces. Generally speaking, the more powerful the trowel, the faster finishing operations can be completed. However, the more powerful the trowel, the more difficult it can become to steer the machine. Crisp, responsive handling is important to optimize the efficiency of the troweling process, and to preserve operator safety and comfort.

Holz, in U.S. Pat. No. 3,936,212 describes a three-rotor trowel powered by a single engine. In U.S. Pat. No. 4,046,484 Holz discloses a twin rotor trowel that is the forefather of many twin rotor designs presently on the market. In both cases, trowel steering and propulsion is effectuated by the combination of rotor tilting and blade twisting. Both prior art Holz devices are powered by a single motor. The rotors are driven by an engine mounted on the frame that is linked to rotor gearboxes. By tilting the axis of rotation of the rotors, steering and directional control are varied. Frictional forces in part related to user selected inclination of the tiltable rotors thus resolve into propulsion forces that move the trowel over the surface being finished. Rotor pitch is adjusted by pivoting the rotor blades about their longitudinal axis.

Notwithstanding their advantages over older manual systems, early riding trowels based upon the original Holz design were cumbersome and difficult to control. My efforts in modifying and improving the steering characteristics of the earlier Holz twin-rotor design resulted in U.S. Pat. No. 5,108,220. The latter reference discloses a fast steering, high power, twin rotor riding trowel that substantially enhances maneuverability and control over prior twin-rotor machines.

Although various versions of three rotor riding trowels have been proposed previously, none have been particularly successful. Prior three-rotor designs have been very difficult to control. Steering has been a vexatious problem. Moreover, tremendous energy losses result from the transmission linkages that are conventionally employed. Further, drive motor linkages, such as the transmission system employed by Holz in U.S. Pat. No. 3,936,212, are unreliable and inordinately complex. For these and other reasons three rotor systems have been largely ignored by the trade. Thus twin-rotor trowels have largely dominated the market. But many of the twin rotor designs have shortcomings as well.

Twin-rotor trowels can have "overlap" problems. When the rotors are spaced apart from one another for clearance purposes, an unfinished region between the revolving blades results. However, one advantage of a three rotor system is that the third rotor "covers" the overlap region between the other two rotors. Further, coverage is provided whether the trowel is running blades or finishing pans.

To remedy the overlap problem, some twin rotor trowels overlap their rotor blades to cover intermediate seams and smooth surface blemishes. In such a case the propeller-like blades must be synchronized so the meshed blades avoid colliding with one another. In single engine machines this presents a timing problem complicating transmission design. In multiple engine designs meshed rotors necessitate properly synchronized motors. Prior approaches at motor synchronization have been difficult electronically and dangerous mechanically. For example, when a twin engine, twin rotor, overlapping machine is mechanically synchronized by interconnecting the motor drive shafts, both motors can be unduly stressed. The problem is amplified by the fact that the rotors are continually tilted during operation, and vastly different dynamic load requirements can be experienced at given times by the individual motors.

One consideration mitigating against the use of meshed rotor trowels is that such designs cannot easily handle finishing pans. Such pans are used to treat green or wet concrete during early stages of the finishing process. They are attached to rotors by seating the rotor blades within suitable brackets. However, they generally cannot be used on trowels where rotor spacing meshes the blades, as adjacent pans collide. To fit pans the rotor spacing must be increased. However, in twin rotor machines if the rotor spacing is increased to accommodate pans, the gap between adjacent rotor blades increases. This necessitates two passes over the area being finished. In some cases it is desirable to use two separate twin rotor trowels that work together in a staggered relationship to finish concrete.

I have pioneered the concept of mating each rotor with its own motor. Single engine, multiple rotor trowels lose energy because power must be distributed between multiple rotors. Finishing speeds thus suffer. Since concrete must be finished before setting, the finishing speed of the trowel is important, and multiple engine trowels are favorable for many job applications. Thus for speed and efficiency it is desirable to associate each rotor with its own engine. A three rotor design as originally suggested by Holz has the advantage of avoiding gaps, as the concrete area between any two rotors is finished by the third rotor. Further, a three rotor system can be fitted with pans and avoid the overlap problem mentioned above. However, the aforesaid Holz design is virtually unusable as the single engine power plant and complex drive train is very inefficient, steering is slow, and control is difficult.

A powerful, three rotor riding trowel that overcomes the foregoing problems is highly desirable. If the individual rotors and their associated gearboxes are independently suspended from one another certain steering advantages result. By generously supplying power with multiple independent motors that are properly isolated from one another a highly efficient and maneuverable steering system can be implemented.

SUMMARY OF THE INVENTION

My improved, high power riding trowel uses three rotor assemblies. Preferably, each is equipped with an independent engine, to attain new levels in riding trowel performance and efficiency. It develops enhanced horsepower, which is coupled to the ground through three, independent rotors. Steering characteristics are radically unlike any other three-rotor riding trowel ever developed or marketed.

This triple rotor riding trowel efficiently maximizes horsepower, while minimizing rotor suspension complexity. The three rotor design lets the operator rapidly finish very large areas of plastic concrete without worrying about overlap problems. The trio of engines independently distributes power evenly through the rotors. Prior twin engine designs require that at least one rotor assembly be titled for motion within two separate planes for steering. However, in my new design each engine need only tilt in one direction. Preferably, the third engine tilts within a plane that is vertically perpendicular to the biaxial plane of tilting established between the other two rotors.

Independently suspended rotors cooperate to avoid overlap problems. The third, front-mounted rotor finishes the concrete zone between the two, rear rotors. At the same time, since the power distribution system and the rotor suspension are independent, the trowel can be effortlessly steered and instantaneously maneuvered.

The preferred trowel comprises a rigid, generally triangular metal frame whose vertices substantially mount separate high-power, internal combustion engines. Each engine powers a gear box axially aligned with the individual rotor assembly through linkage arrangements that are independent of one another. The steering and blade pitch linkages are preferably hydraulically actuated. Hydraulic control switches are accessible to the operator from his seat. Although it might appear at first blush that the symmetry hitherto thought to be advantageous in conjunction with twin-rotor machines has been broken, the third engine complements the other two engines. First, is aids in the steering of the device and contributes to optimum weight distribution. Secondly, it enhances trowel stability and maneuverability.

As in the case of my prior twin-engine, twin-rotor designs, a separate rotor and motor assembly is disposed at each side of the operator. The third engine, however, is preferably disposed in front of the operator, at the front of the frame. In other words, it is suspended at the major vertice of an isosceles triangle, whose orientation is such that unit power and weight are distributed to optimize frictional steering effects responsible for riding trowel steering and propulsion. Moreover, the vector force and mass distribution ratios resulting from the particular triangular frame design establish the critical balance necessary to steer and control the trowel on a par with the best of the prior art twin rotor designs.

Thus a fundamental object of my invention is provide a high speed, high power riding trowel that finishes concrete without gaps.

A related object is to minimize the "overlap" problem hitherto experienced with twin rotor riding trowels.

Another fundamental object of my invention is provide a high speed, high power riding trowel that is extremely easy to steer.

Another basic object is to provide a high speed trowel that quickly and efficiently delivers its considerable horsepower to multiple rotors.

It is also an object to provide a high power riding trowel that easily and efficiently pans wet concrete.

Another important object is to provide a high power riding trowel that overcomes power-draining vacuum effects that occur when panning wet concrete.

Another object is to provide a high speed, high power riding trowel of the character described with independent suspension and control apparatus.

Another fundamental object is to independently, hydraulically control each of the rotors in a multiple rotor trowel. It is an important feature of the invention that each rotor is tilted by a hydraulic cylinder.

A related object is to provide an electrical control system for actuating the hydraulic system in a multiple rotor trowel design. It is a feature of this invention that "joystick steering" is employed for ultimate trowel ride control in conjunction with the hydraulics.

Yet another significant object of the present invention is to provide a high powered, multi-engine riding trowel that is inherently stable. While it is of course known that three points determine a plane, and stability might seem inherent in a triple rotor trowel, all known prior art designs have been temperamental and difficult to steer.

Another basic object is to provide a three-engine trowel that distributes engine weight and power through a properly configured frame. It is a feature of my new riding trowel that the triangular frame configuration and the rotor mounting configuration stabilize the trowel and harmonize influences of the third rotor.

Yet another important object is to provide a three motor trowel wherein each of three rotor gearboxes is independently driven by a separate motor.

A related object is to provide a triple motor trowel that mechanically isolates each rotor from the others.

Another basic object of the invention is minimize the complexity of rotor steering in a multiple rotor trowel. It is a unique feature of the present invention that, for the first time in a powered riding trowel, none of the rotors need tilt in more than one plane to effectuate steering.

Another basic object of the present invention is to provide a trowel that uses separate engines to concurrently rotate multiple rotors to finish concrete.

Yet another important object is to provide a triple motor trowel wherein each rotor gearbox is independently driven.

A related object is to provide a triple motor trowel that tends to isolate each rotor from shocks experienced by the other.

Yet another important object is to provide a riding trowel that radically increases operator production.

Another object is to provide a riding trowel that is particularly well suited for use on quick curing concrete jobs.

A related object of the present invention is to provide a triple rotor trowel wherein the rotors function individually.

Yet another basic object of the present invention is to provide a three rotor, three engine trowel wherein the rotors press incoming concrete inwardly towards the trowel center during forward movement.

Another basic object is to provide a three engine, three rotor riding trowel wherein the rear rotors press incoming concrete towards the trowel periphery during forward movement, i.e., contra rotation.

A related object is to provide a multiple-rotor riding trowel that can function adequately when the rear rotors are configured for standard rotation, i.e., they press incoming concrete toward the trowel center during forward movement.

Yet another important object is to provide a three engine, three rotor riding trowel wherein the rotors flatten the concrete surface sufficiently to attain the high "F-numbers" (i.e., flatness characteristics) that are established by certain ACI regulations.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and are to be construed in conjunction therewith, and in which like reference numerals have been employed throughout in the various views wherever possible.

DETAILED DESCRIPTION

Figure 15:
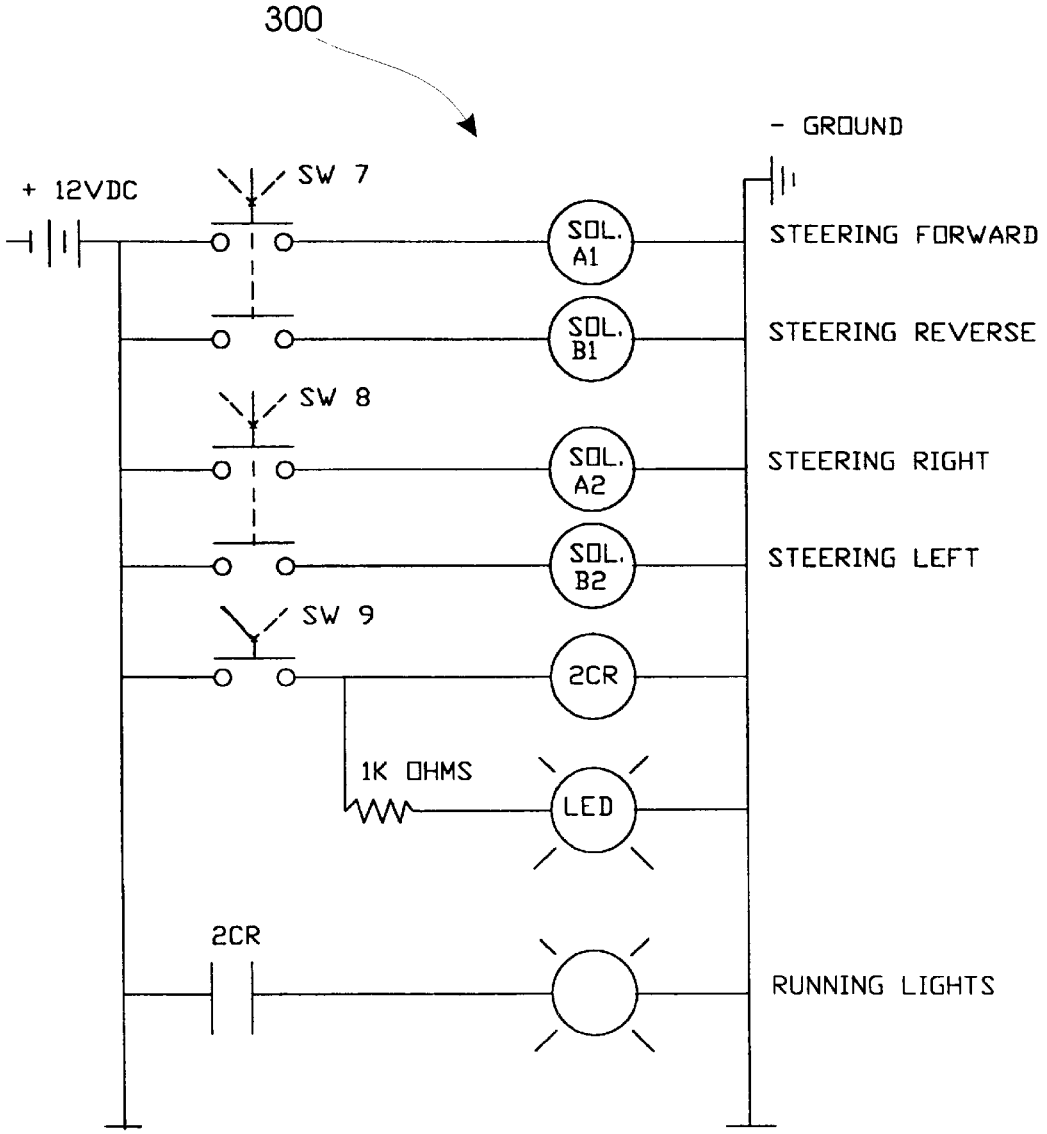
FIG. 15 is an electrical schematic of the right hand joystick control circuit; and, FIG. 16 is an electrical schematic of the left hand joystick control circuit.
Figure 16:
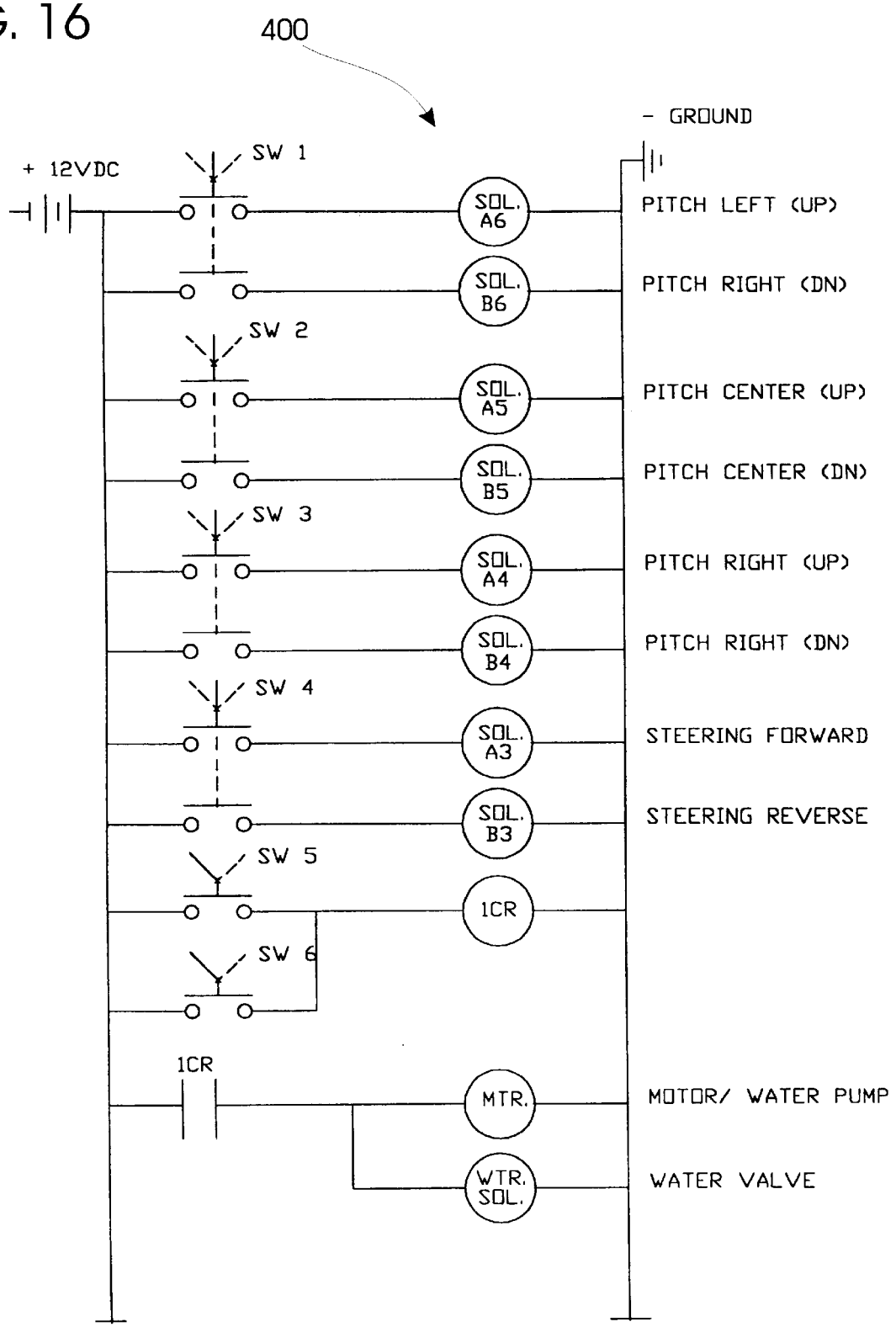

With attention directed initially to FIGS. 1–4 of the accompanying drawings, the best mode of my three rotor, three motor riding trowel is broadly designated by the reference numeral 20. Trowel 20 comprises three separate rotor assemblies, which are disposed at the corners of the generally triangular frame. Preferably, each rotor is independently driven by a separate engine as discussed below. As discussed hereinafter, each rotor assembly is pivotally suspended for movement in a single plane generally at a vertice of the triangular frame. The self propelled trowel 20 is designed to quickly and reliably flat finish large areas of concrete surface 21. An operator (not shown) comfortably seated within seat assembly 23 can operate the entire machine with an easy-to-use joystick controlling system seen schematically in FIG. 14. The left hand joystick 24B (FIGS. 1, 2) is preferably wired according to circuit 300 (FIG. 15) and the right hand joystick 24A is preferably wired according to circuit 400 (FIG. 16). A foot-operated motor throttle control 74 (FIG. 1) is accessible from seat assembly 23.

Figure 1:
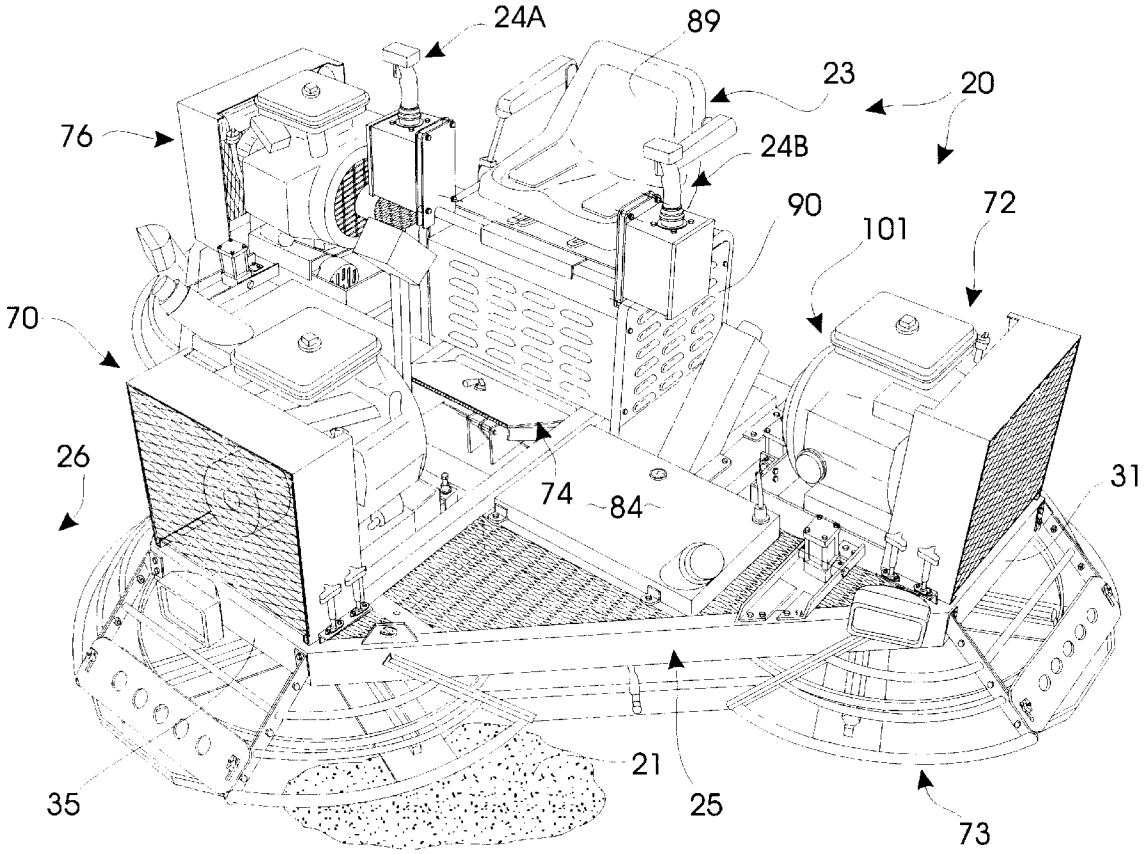
FIG. 1 is a front, environmental, perspective view of my new trowel showing the best mode of the invention known to me at this time.
Figure 2:
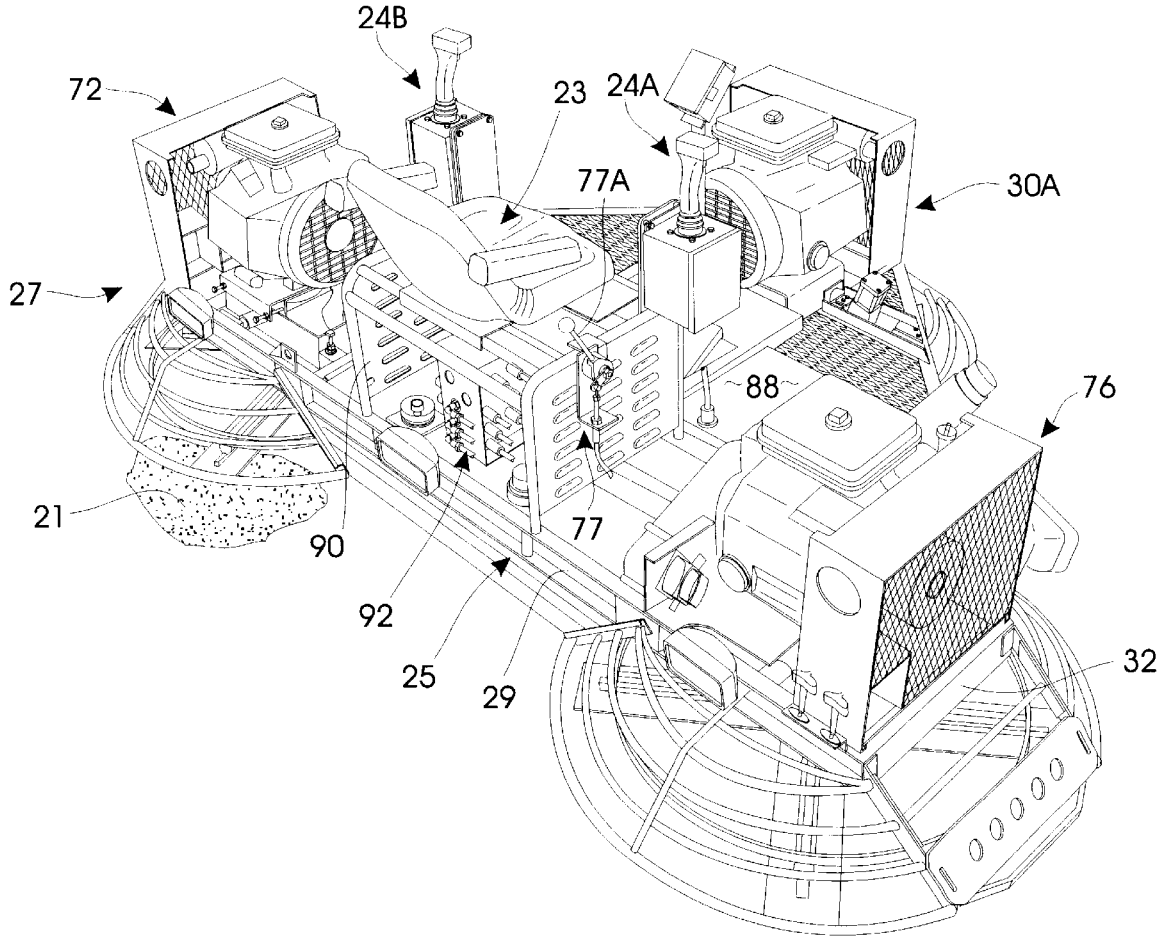
FIG. 2 is a fragmentary rear perspective view of the trowel.

A rigid, generally triangular, metallic frame 25 fabricated from channel steel has a front 26 (FIG. 1) and a rear 27 (FIG. 2). Frame 25 comprises a transverse base 29 that extends across the rear 27 of the frame between frame ends 31, 32. Ends 31, 32 are rigidly affixed to frame sides 33, 34 which form the sides of a triangle and terminate at a transverse, frame front 35. The frame is internally reinforced by transverse strut 40 that is parallel with and spaced apart from base 29. The parallel frame braces 42, 44 extend from strut 40 to front 35 to further reinforce the frame. Similarly transverse struts 46, 47 (FIGS. 3, 4) extend between braces 44, 42 to sides 33, 34 respectively for reinforcement.

Figure 3:
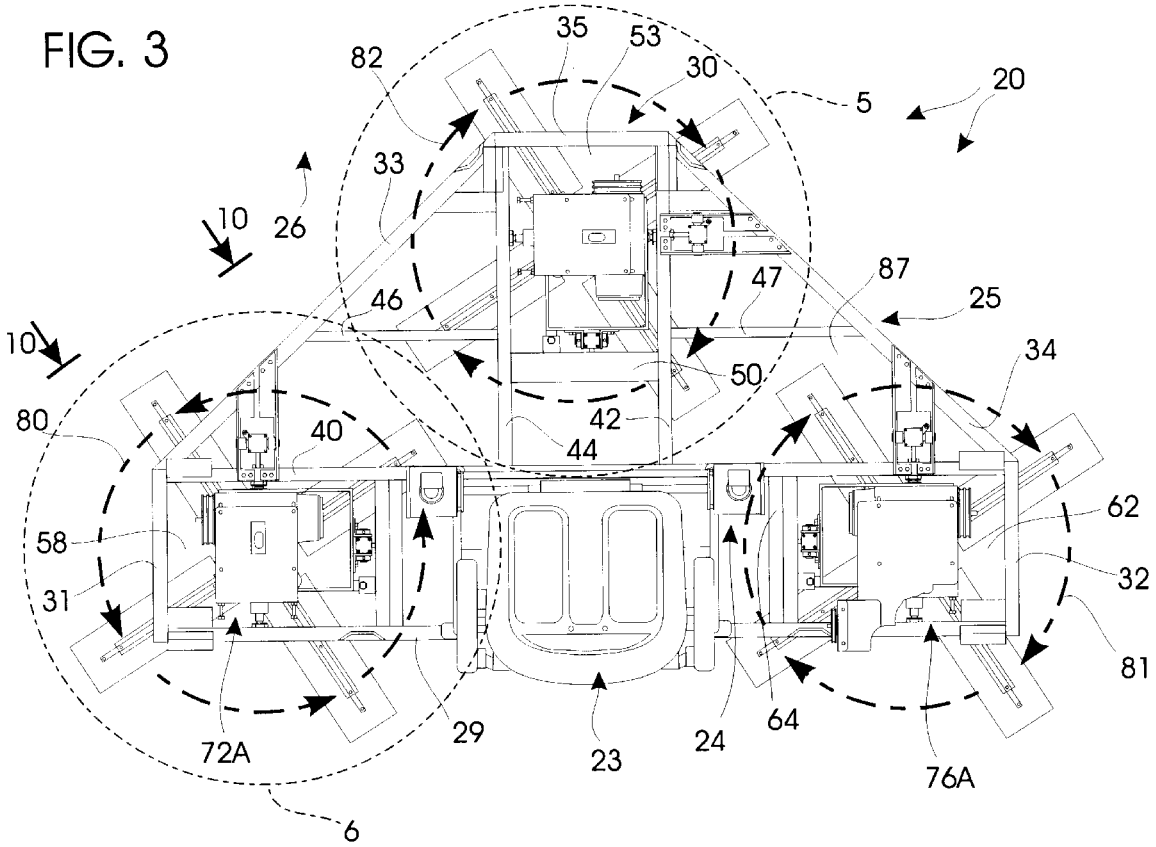
FIG. 3 is a fragmentary top plan view of the new trowel with portions thereof omitted or broken away for clarity.
Figure 5:
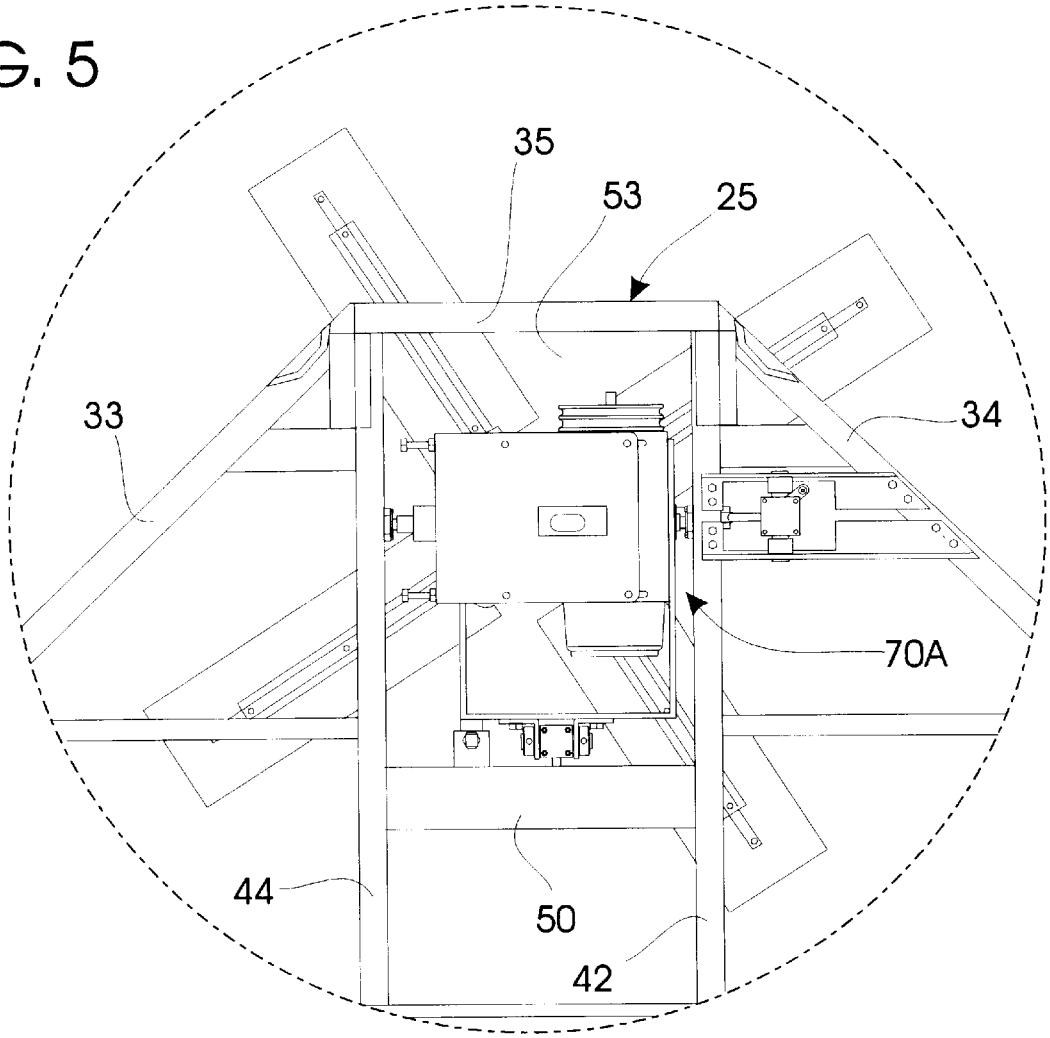
FIG. 5 is an enlarged, fragmentary, top plan view of circled portion 5 of FIG. 3, with portions thereof broken away for clarity or omitted for brevity.
Figure 6:
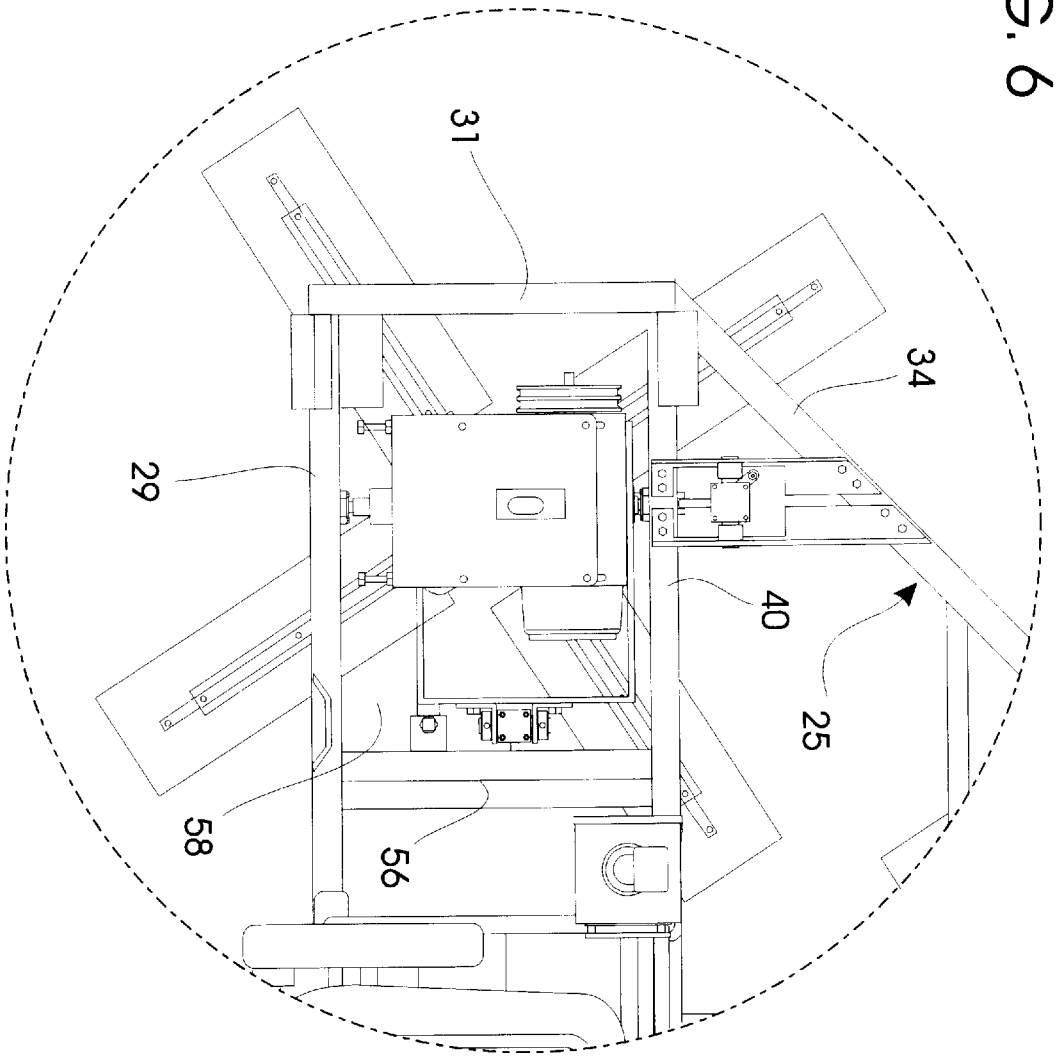
FIG. 6 is an enlarged, fragmentary top plan view of circled portion 6 in FIG. 3, with portions broken away for clarity or omitted for brevity.
Figure 7:
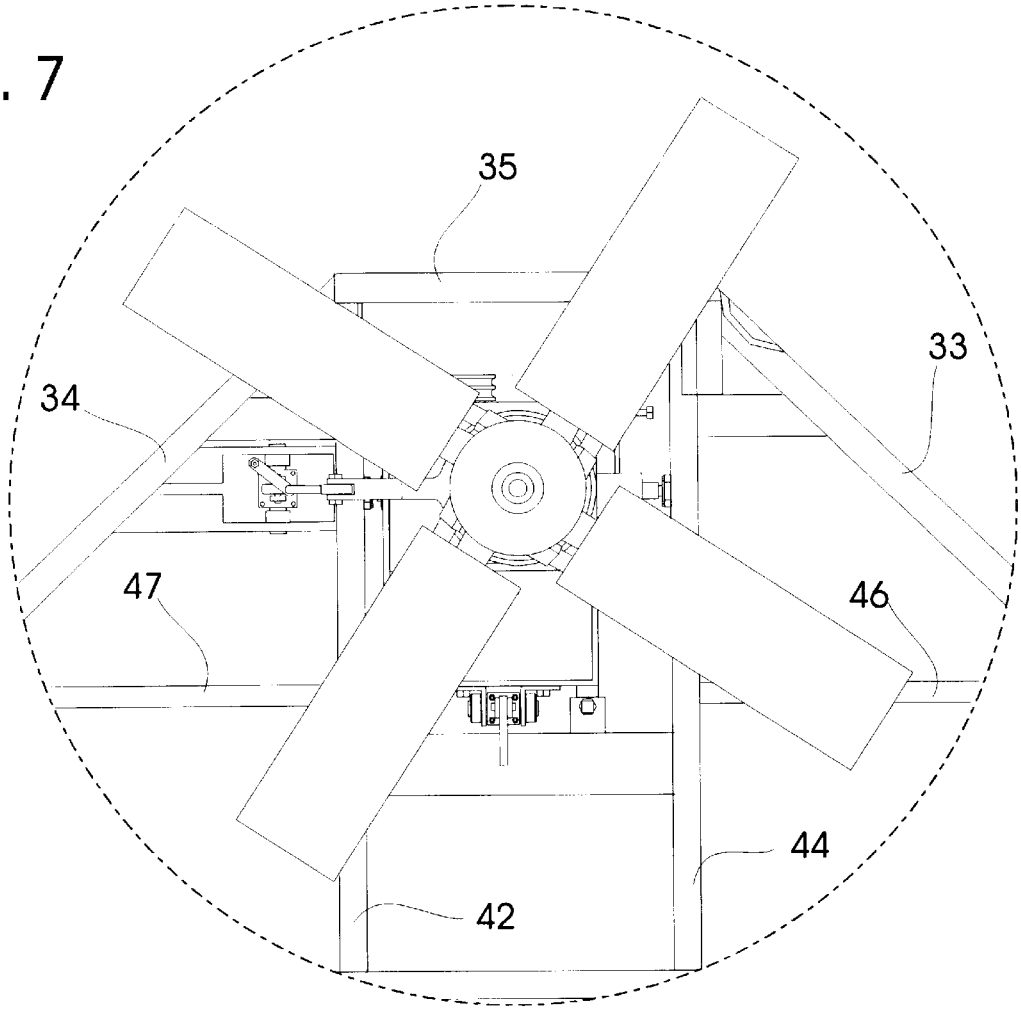
FIG. 7 is an enlarged, fragmentary bottom plan view of the frame front taken generally from the underside of FIG. 5, with portions broken away for clarity or omitted for brevity.
Figure 8:
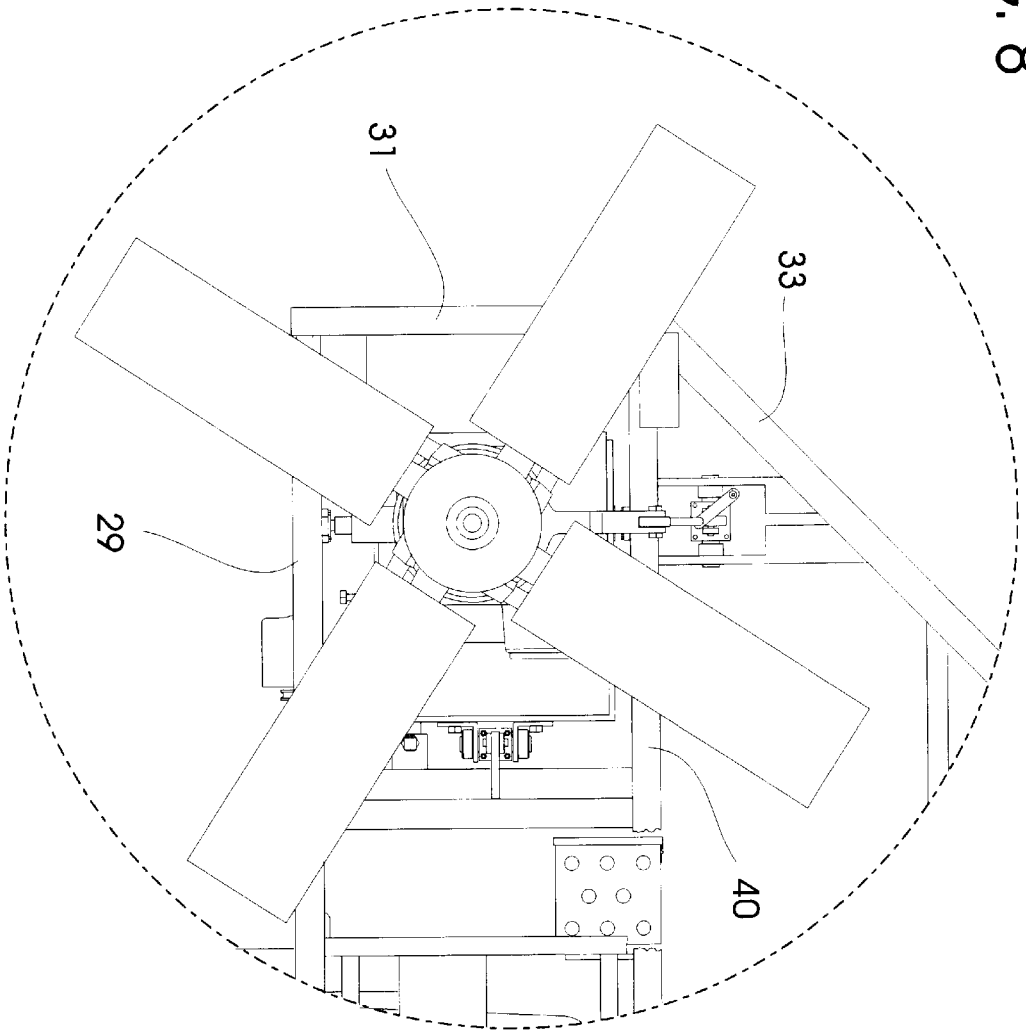
FIG. 8 is an enlarged, fragmentary bottom plan view of the left side of the frame, taken generally from the underside of FIG. 6, with portions broken away for clarity or omitted for brevity.

An internal brace 50 that is parallel with and spaced apart from front 35 extends between braces 42, 44 (FIGS. 3, 5). A recessed gearbox mounting cavity 53 is defined between brace 50, front 35 and braces 42, 44. As will hereinafter be explained in detail, the front rotor gearbox is pivotally mounted within this cavity. The left rear of the frame is reinforced with a doubled, channel steel brace 56 that extends between frame base 29 and strut 40. A recessed gearbox mounting cavity 58 (FIGS. 6, 9) for the left rear rotor is defined between frame end 31, brace 56, strut 40 and base 29. Similarly, recessed gearbox mounting cavity 62 (FIG. 3) for the right rear rotor is defined between frame end 32, brace 64, strut 40 and base 29.

Figure 4:
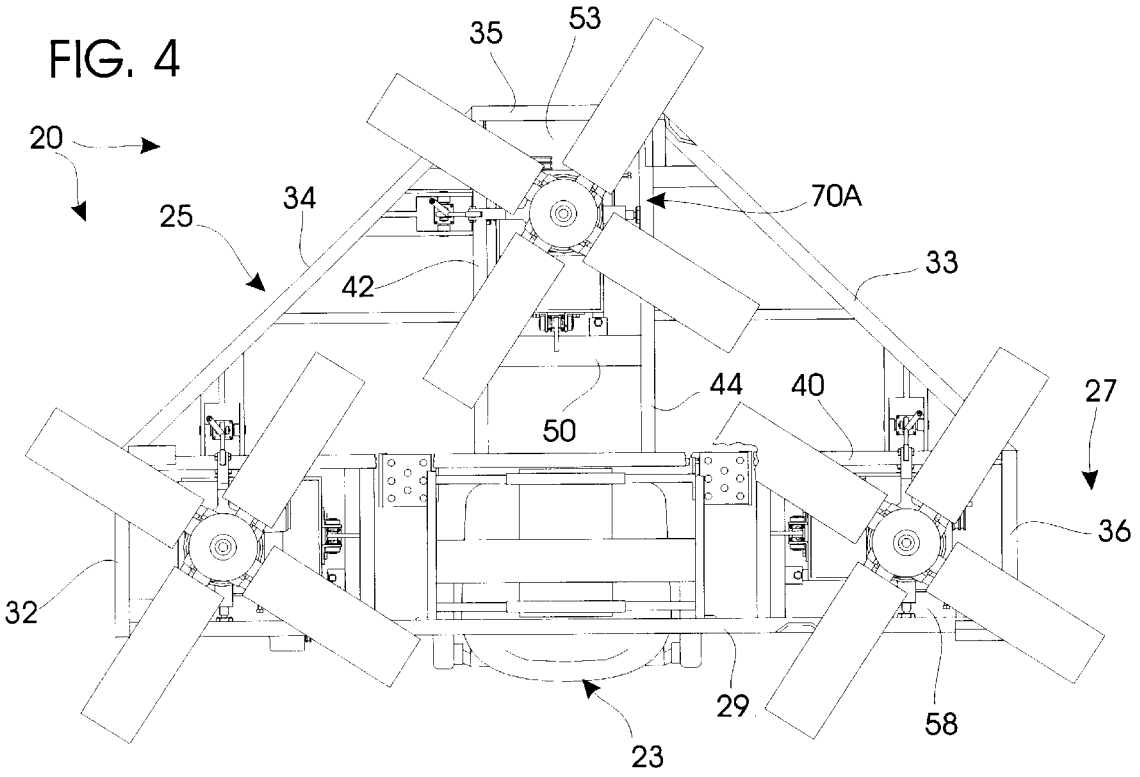
FIG. 4 is a fragmentary, bottom plan view with portions omitted for clarity.

The trowel comprises three separate bladed rotors that support the trowel upon the concrete surface 21. In the best mode each rotor assembly comprises a separate engine. A front motor 70 drives a front rotor assembly 70A (FIGS. 4, 5). The left rear motor 72 drives rotor assembly 72A (FIGS. 1, 3). Similarly the right rear motor 76 independently drives rotor assembly 76A. In the best mode the left and right rear rotors revolve in the opposite radial directions indicated by arrows 80, 81 (FIG. 3). In the best mode known to me at this time the front rotor revolves in a clockwise direction indicated by arrow 82 (FIG. 3). When the rear rotors revolve in this preferred "contra-rotation" mode they press incoming concrete about the trowel periphery during forward trowel movement. However it is within the scope of the invention to employ "standard rotation" wherein the rear rotors revolve oppositely from arrows 80, 81. The latter, although not preferred, is referred to as "standard rotation." In the latter mode the rotors press incoming concrete toward the trowel center and between the rotors during forward movement.

Preferably, the rotor assemblies 70A, 72A and 76A are powered by belt driven gear boxes that are clutch driven by the motors. Details as to the construction of typical gear boxes, motor linkages, rotor blade linkages, clutch connectors, blade pitch controls and the like may be found in my prior U.S. Pat. Nos. 5,108,220 and 5,480,258 which are hereby incorporated by reference. Each rotor is protectively shrouded by a cage assembly 73 that prevents human contact with the revolving rotor blades that frictionally finish the concrete surface.

A first fuel tank 84 (FIG. 1) is recessed within the frame area 83 defined between struts 40, and 46. A companion fuel tank 88 (FIG. 2) is mounted within cavity 87 (FIG. 3) defined between internal frame struts 40, 47. The seat assembly 23 comprises a chair 89 disposed upon a ventilated, upright enclosure 90 positioned between the motors 72, 76. Enclosure 90 houses a battery (not shown) for the electrical system and a hydraulic valve system for controlling the hydraulic actuators to be hereinafter discussed. A cruise control 77 (FIG. 2) is accessible from the right side of the seat to lock in selected motor speed. Cables (not shown) from the variable foot control 74 (FIG. 1) establish motor speed by displacing the motor throttle linkages (not shown). Handle 77A may be conveniently grasped by the user to lock the throttles in a cruise control mode.

Figure 9:
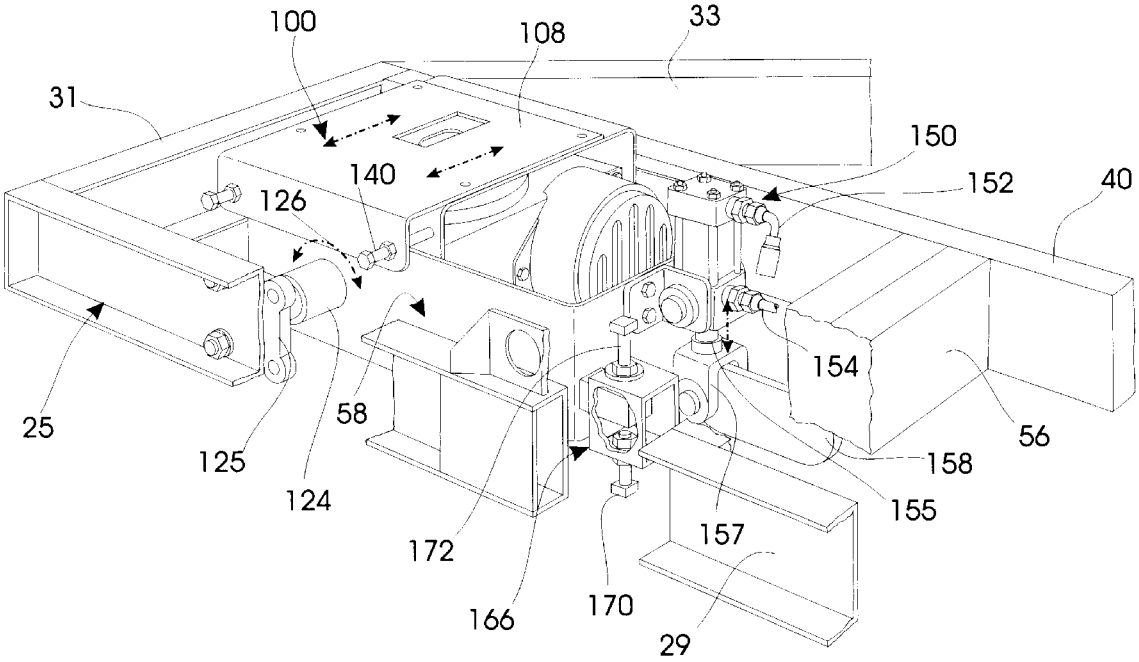
FIG. 9 is an enlarged, fragmentary rear isometric view, with portions broken away or omitted for clarity, showing the left side rotor mounting.

With primary reference to FIGS. 9–13, the rotor pivot system and rotor mounting system will now be described in detail. FIG. 9 shows the left rear frame assembly wherein the cavity 58 receives the rotor gear box. The three rotor assemblies are substantially similar structurally, except for the tilting and mounting angles, and so only one will be described in detail.

The rotor pivot system has been generally designated by the reference 100. The rotor comprises a generally cubical gear box 102 (FIG. 11) that is pivotally disposed within the cavity 58 (FIG. 9) defined by the frame struts previously discussed. The rotor gear box 102 is driven through a pair of pulleys 104 and belts 105 (FIG. 11) extending to a clutch driven by a motor 101 (FIG. 1) positioned above that is adjustably secured at the top of the assembly to the motor mounting plate 108. The gear box 102 is mounted within the pivot steering box 109 (FIG. 11) of generally U-shaped cross section. Pivot steering box 109 comprises opposite, parallel sides 111, 112 which are secured with a plurality of fasteners 115 that penetrate orifices 116, 116A and are received within internally threaded orifices 117 in the sides 102A of the gear box 102. A top plate 120 is nested about the gear box with its opposite, downwardly projecting sides 121, 122 sandwiched between the gear box sides and the pivot steering box sides 111, 112.

A pair of trunnions 124 are rigidly secured to the sides 111, 112 of the pivot steering box 109, and extend outwardly therefrom. These trunnions support the rotor/motor combination for pivoting. The trunnions are journalled within suitable bearings 125 (FIG. 9) so that the rotor may be pivoted back and 11 forth in the direction of arrow 126. As the pivot steering box is so deflected within the cavity 58, the motor is pivoted as well. As explained in my prior United States patents, steering of riding trowels is effectuated by such tilting.

Figure 11:
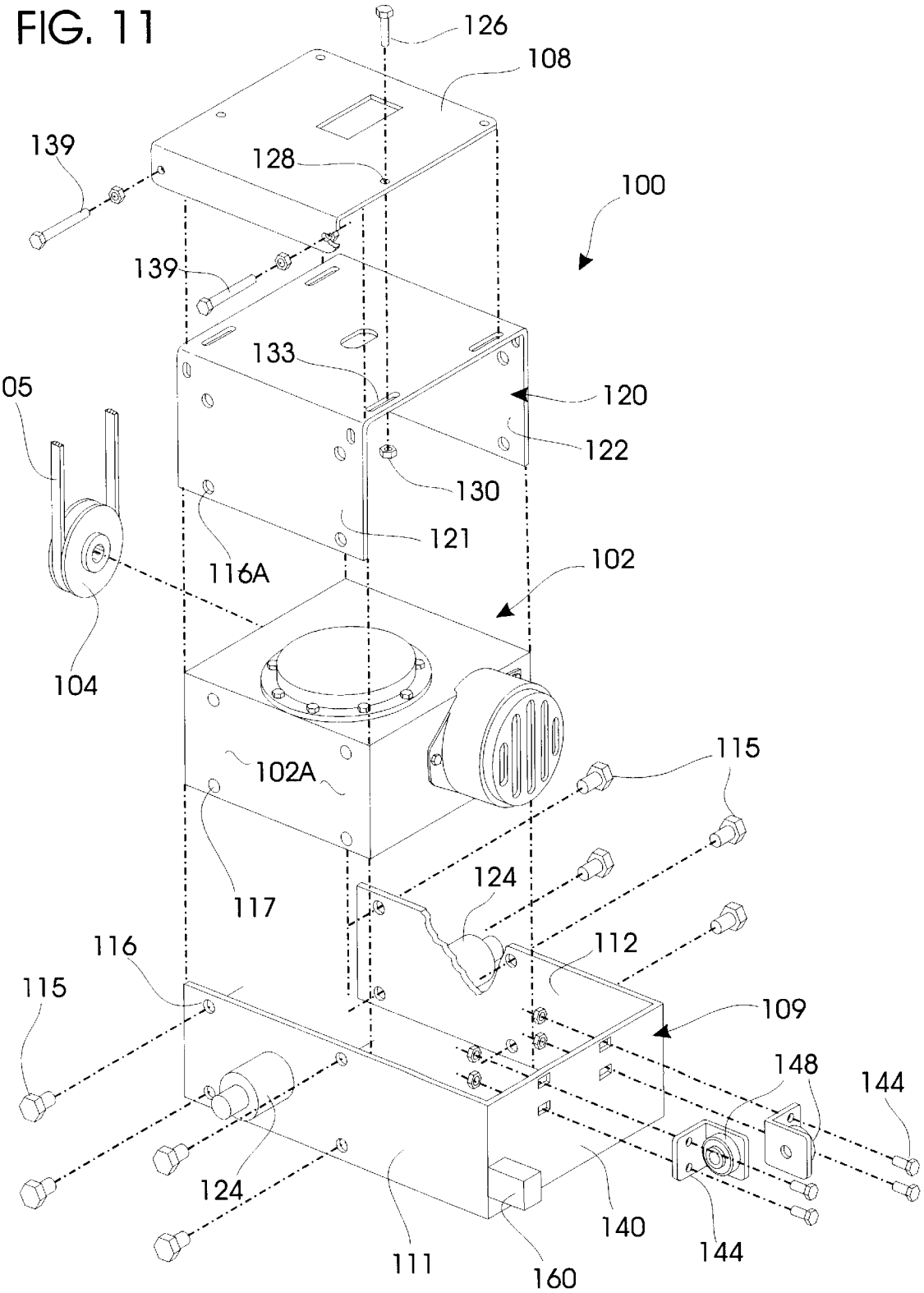
FIG. 11 is an exploded isometric view of a preferred rotor mounting system.

In the best mode the internal combustion motor is secured to the motor mounting plate 108 (FIG. 9) which is in turn secured to plate 120 sitting atop the gear box. Suitable fasteners 126 penetrate portions of the mounting feet (not shown) provided on the motors and orifices 128 are secured by nuts 130. Plate 108 may be moved relative to lower plate 120 as fasteners 126 register within slots 133 (FIG. 11). When the motor is properly aligned the fasteners 139 are appropriately tightened.

The front face 140 of the pivot steering box 109 is mechanically deflected for pivoting. A pair of L-brackets 144 extend outwardly from face 140 being mounted by fasteners 144. These brackets include internal bearings 148 that receive a suitable shaft (not shown) extending through the base of a hydraulic actuator 150 (FIG. 9). The hydraulic actuator is controlled by suitable valves through lines 152, 154. The hydraulic cylinder rod 155 drives a clevis 157 that is pivotally connected to a stationary frame member 158. As rod 155 (FIG. 9) is extended or retracted in response to hydraulic pressure, the pivot steering box 109, the gear box and the motor are pivoted generally as indicated by arrow 126 (FIG. 9).

Figure 14:
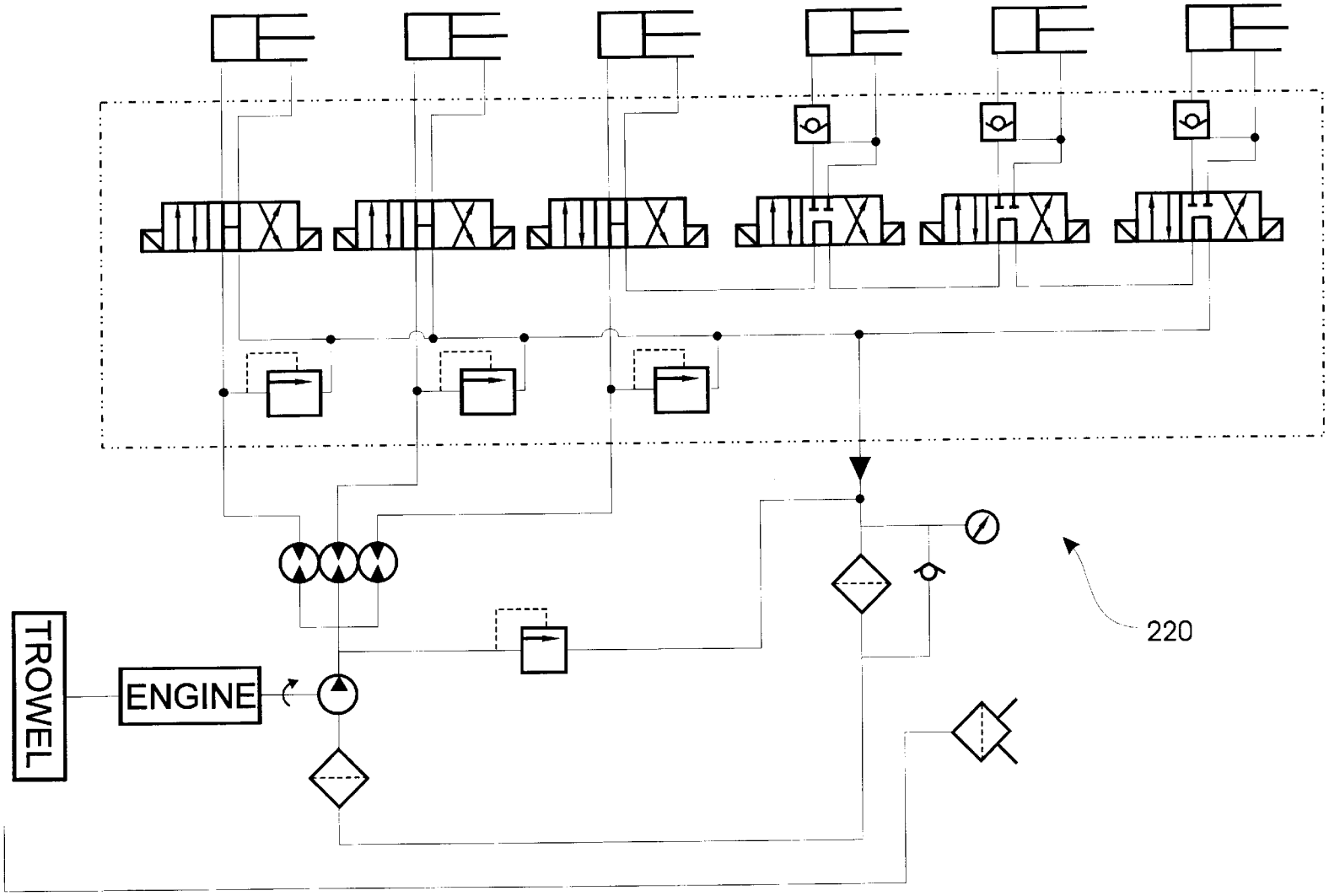
FIG. 14 is a hydraulic schematic diagram.

A rigid pivot stop 160 (FIG. 11) projects outwardly from pivot steering box face 140. This stop is received within a rigid, somewhat cubicle enclosure 166 (FIG. 9) that establishes the maximum travel of stop 160 in a pivoting arc. To this effect, travel ends when stop 160 hits either bolt 170 or 172 within housing 166. Thus stop 160 limits travel when it engages the end of adjustable bolts 170 or 172 that project into the bottom or top of the housing 166 respectively. As best viewed in FIG. 9, bolts 170, 172 can be adjusted to limit the amount of hydraulic pivoting by appropriately adjusting the jam nuts to which they are secured. FIG. 14 broadly illustrates the preferred hydraulic circuit 220.

Figure 12:
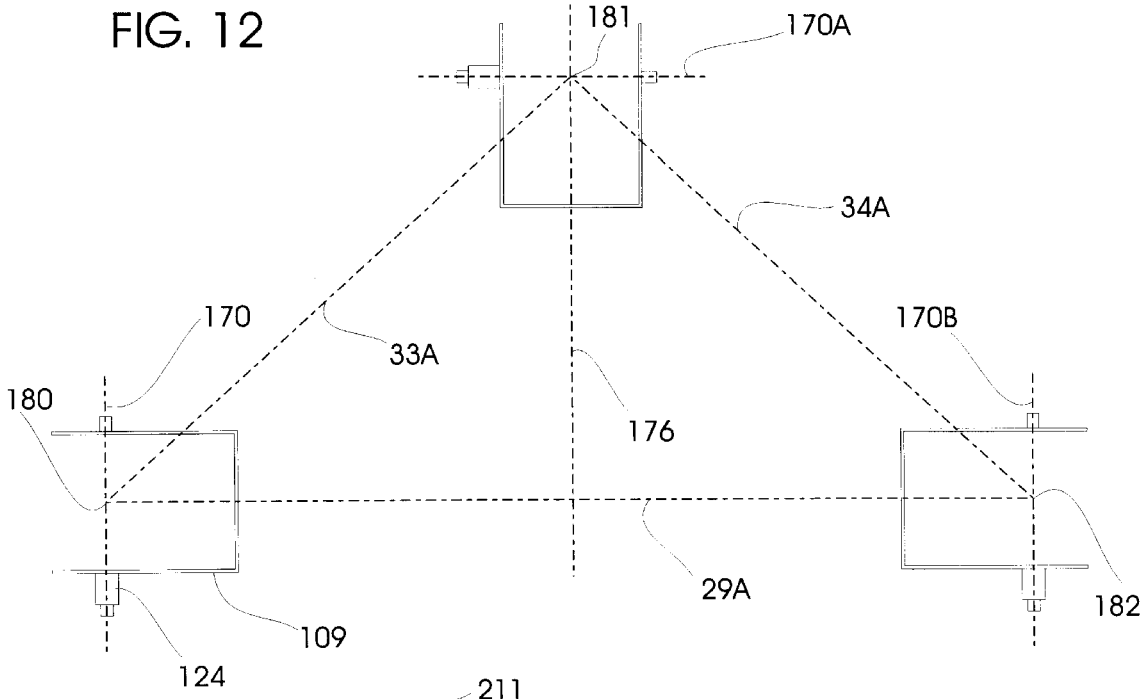
FIG. 12 is a free body diagram showing the preferred frame layout.
Figure 13:
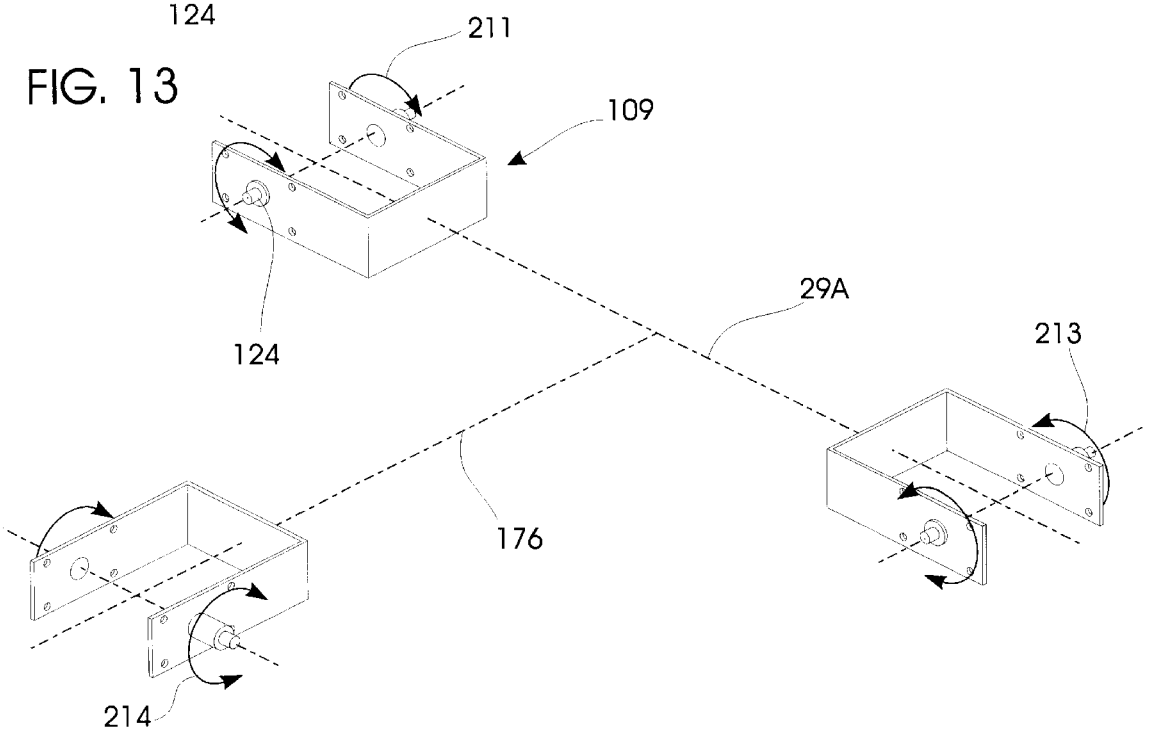
FIG. 13 is a fragmentary, pictorial view of the preferred rotor tilting mechanisms.

Turning to FIGS. 12 and 13, the pivot steering box 109 previously discussed is shown schematically. Its axis of rotation has been generally designated by the dashed line 170. Similarly the axis of rotation of the front pivot steering box has been designated by the reference numeral 170A and the axis of rotation of the right rear pivot steering box has been designated by the reference numeral 170B. As can be seen from FIGS. 12 and 13, the plane of rotation of the rotor assemblies at the rear occupies a plane generally coincident with line 29A. The coincident, pivoted steering plane aforementioned is perpendicular to the plane of the rotation of the front rotor designated by dashed line 176 (FIG. 12). In other words, the plane of rotation of the front pivot steering box is substantially perpendicular to the plane of rotation of the rear rotors. As seen in FIG. 13, the axis of rotation of the left rear pivot steering box (indicated by arrow 213) is parallel with the axis of rotation of the right rear box (indicated by arrow 211). The axis of rotation of the front pivot steering box, indicated by arrow 214, is thus perpendicular to the axis of rotation of either rear rotor.

Points 180, 181 and 182 represent the effective free-body vertices of the dynamic triangular frame. In other words, points 180–182 represent the concentration of mass or the center of mass of the rotor/motor assemblies disposed generally at the vertices of the triangular frame. As can best be viewed from FIG. 11, the sides of the frame are equal and the triangular configuration is isosceles. The preferred angle between the base and each side is between 30 and 50 degrees. In the best mode it is approximately 42 degrees. In the best mode known to me at this time, the distance between points 180 and 182 (i.e., the base of the triangle) is 81 inches. The distance between point 181 and line 29A (FIG. 12), corresponding to the altitude of the triangle, is approximately $37\frac{17}{64}$ inches. Experimentation has revealed that for best steering control, the altitude should be approximately 40%–50% of the base width.

In addition to the dimensional relationships discussed above, weight distribution must be correctly established for optimum results. Experimentally it appears that the weight at the left rear rotor (point 180 in FIG. 12) and right rear rotor (at point 182) will vary between 800–1000 pounds each. These rear rotors should ideally be weighted within 10%–15% of each other. I have found that the best mode known to me at this time requires approximate 50%–70% of this weight at the front rotor at point 181 (FIG. 12). In the best mode, with all water tanks (i.e., for optional sprayers not shown), fuel tanks, and hydraulic tanks full, the observed weight at point 180 is 842 pounds. The weight at point 182 is 948 pounds, and the weight at point 181 (FIG. 12) at the front is 418 pounds.

Figure 10:
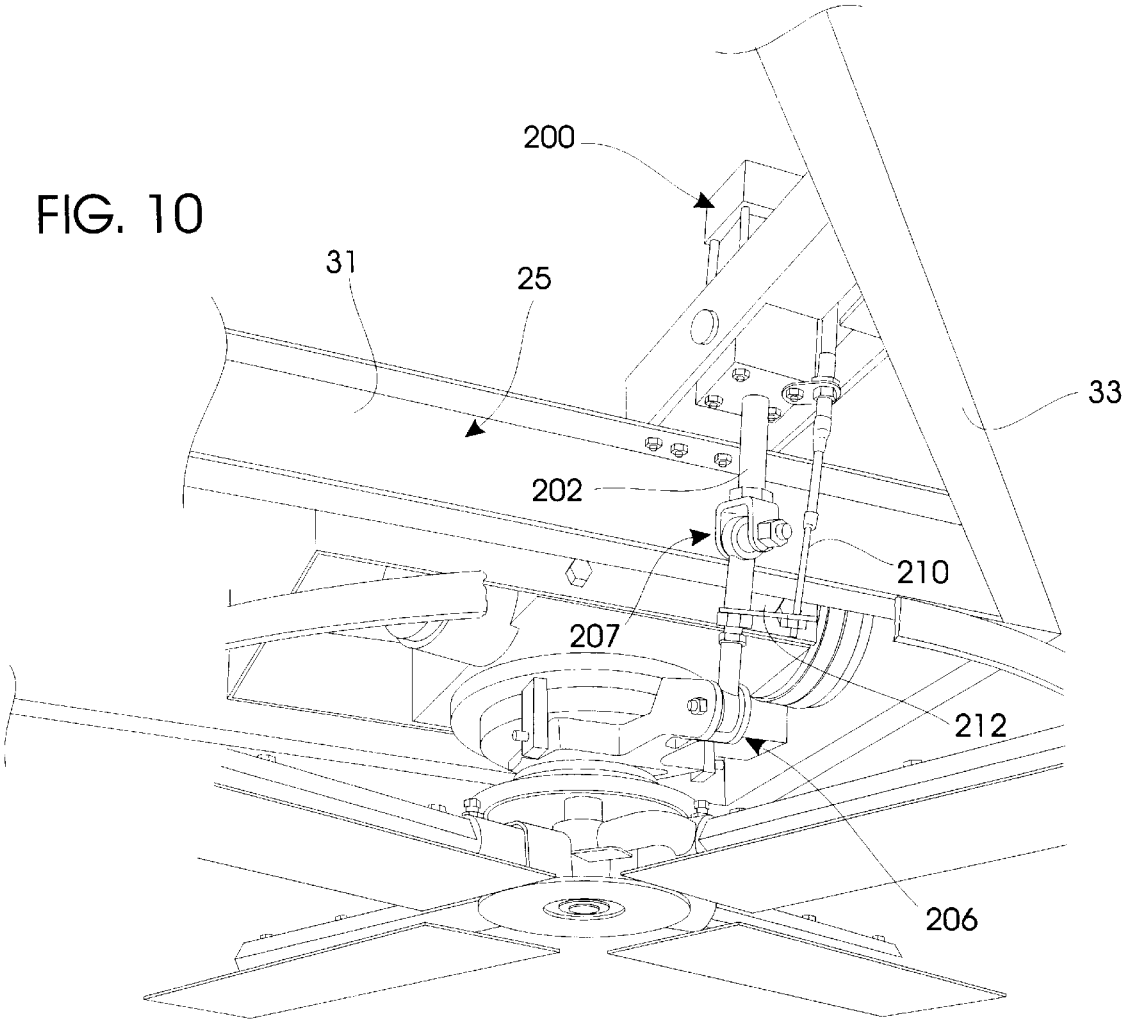
FIG. 10 is an enlarged, fragmentary perspective view of the underside of the left rear rotor, taken generally from a reference point established by line 10—10 in FIG. 3.

Turning now to FIG. 10, an auxiliary hydraulic control unit 200 operates a plunger 202 that is interconnected to the fork 206 operating the rotor assembly thereshown. The operation of the pitch control fork 206 has been explained previously in conjunction with my above referenced patents. Hydraulic control 200 is coupled to the fork through a suitable connection 207. A cable 210 connected to a plate 212 travels with the fork 206 in response to hydraulic actuation. Cable 210 leads to a blade pitch indicator (not shown). Once hydraulic instructions have been conveyed to control 200 through the joy-stick controllers 24, previously discussed, the pitch of the various blades (i.e., established by the position of the fork 207) can be selected.

Operation

In operation a variety of operator precautions must be observed, as is the case with prior art motorized trowels. The hydraulic tanks should be periodically inspected for proper level, and the rotor blades must be changed as necessary after routine inspections for wear. Fuel tank levels must be sufficient for extended periods of use. During the initial finishing of wet concrete, proper pans will first be installed on the rotors by coupling the rotor blades to the radially spaced apart brackets provided.

Normally the engines are started one at a time. With all engines running, throttle control of each occurs concurrently by pressure on the foot control. Once the engines are running, suitable throttle speed will be sufficient to activate the clutches causing rotor rotation. Once the rotors are activated, the joystick controls may be activated to steer and control the trowel. As the joysticks are used, electrical connections seen in FIGS. 15 and 16 will activate corresponding hydraulic control valves (FIG. 14) to tilt the various rotors to cause steering. As explained in my prior patents, steering and propulsion in a riding trowel results from unbalanced frictional forces developed by the rotors (i.e., either the blades or the pans) against the lower concrete surface.

In the preferred "contra rotation" mode (i.e., note rear rotor direction arrows 80, 81 in FIG. 3) pressure applied to the outside of the left and right rotors will cause the machine to move forwards. At this time the front rotor is not tilted—it remains in a neutral position. The rear rotors are tilted however to apply pressure on their outermost sides, with lesser pressure appearing between the rear rotors. If this is reversed, i.e., pressure is applied to the inside of the left and right rear rotors by tilting them appropriately with the double acting cylinders, then the machine will move in reverse. Again, in the best mode known to me at this time, during reverse travel the front rotor is neutral.

With the rear rotors untilted (i.e., neutral) subsequent tilting of the front rotor to concentrate pressure at its front (i.e., at the front of the riding trowel ) will cause the trowel to make a left hand, wide sweeping turn. At this time the front rotor revolves as indicated by arrow 82 (FIG. 3). Again, with the rear rotors untilted (i.e., neutral) tilting of the front rotor to concentrate pressure at its rear (i.e., towards the interior of the riding trowel frame) will cause the trowel to make a right hand, wide sweeping turn.

If pressure is applied to the outside of the right rotor and the inside of the left rotor, with the front rotor neutral, the trowel will execute a hard left turn. This tilting is reversed for a hard right turn. Again the front rotor is neutral. To "crab" left, i.e., move sideways leftwardly, pressure is applied to the front of the front rotor and to the outside of the rear rotors. To "crab" right pressure is applied to the rear of the front rotor and to the outside of the rear rotors. Obviously by varying the inclination of the rotors in a plurality of other combinations a wide variety of trowel maneuvers can be executed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized riding trowel for finishing a concrete surface, said riding trowel comprising:

a rigid, generally triangular frame having two rear vertices and a spaced apart front vertice;

a front rotor assembly and a pair of spaced apart rear rotor assemblies for powering said riding trowel and frictionally contacting said concrete, the rear rotor assemblies mounted upon said rear vertices and said front rotor assembly mounted upon said front vertice, each rotor assembly comprising a single pivot axis, wherein the plane of the pivot axis of each rear rotor assembly is coplanar with one another and perpendicular to the concrete surface, and the plane of rotation of the front rotor assembly is perpendicular both to the plane of rotation of the rear rotor assemblies and said concrete surface.

2. The riding trowel as defined in claim 1 further comprising motor means for powering the rotor assemblies.

3. The riding trowel as defined in claim 1 further comprising cylinder means for selectively tilting said rotor assemblies.

4. The riding trowel as defined in claim 3 further comprising circuit means for electrically activating said cylinder means.

5. The riding trowel as defined in claim 3 further comprising joystick means for selectively activating said cylinder means.

6. The riding trowel as defined in claim 1 wherein:

said frame comprises a plurality of cavities generally located at said vertices;

each rotor assembly comprises a motor driven gear box and a pivot steering box of generally U-shaped cross section for securing the gear box;

wherein each pivot steering box comprises trunnions pivoted to said frame within said cavities for supporting the rotor assembly and enabling pivoting.

7. The riding trowel of claim 6 further comprising pivot stop means for mechanically limiting gear box pivoting.

8. The riding trowel of claim 1 wherein the frame is shaped like an isosceles triangle.

9. The riding trowel of claim 8 wherein the angle formed between the frame base and each side is approximately 30–50 degrees.

10. The riding trowel of claim 8 wherein the angle formed between the frame base and each side is approximately 42 degrees.

11. The riding trowel of claim 1 wherein the triangular frame has a base and an altitude, and the altitude length is approximately 40%–50% of the base length.

12. The riding trowel of claim 1 wherein the weights borne by the rear rotor assemblies are within 10%–15% of each other.

13. The riding trowel of claim 1 wherein the front rotor assembly bears approximate 50%–70% of the weight of the trowel.

14. A motorized riding trowel for finishing a concrete surface, said riding trowel comprising:

a generally triangular frame having two rear vertices and a spaced apart front vertice, a base, and an altitude;

a front rotor assembly and a pair of spaced apart rear rotor assemblies for powering said riding trowel and frictionally contacting said concrete, the rear rotor assemblies mounted upon said rear vertices and said front rotor assembly mounted upon said front vertice, each rotor assembly comprising a single pivot axis, wherein the plane of the pivot axis of each rear rotor assembly is coplanar with one another and perpendicular to the concrete surface, and the plane of rotation of the front rotor assembly is perpendicular to the planes of rotation of the rear rotor assemblies;

each rotor assembly comprising a separate drive engine;

cylinder means for selectively tilting said rotor assemblies to effectuate steering and control; and, joystick means for selectively activating said cylinder means.

15. The riding trowel as defined in claim 14 wherein:

said frame comprises a plurality of cavities generally located at said vertices;

each rotor assembly comprises a motor driven gear box and a pivot steering box of generally U-shaped cross section for securing the gear box; and, wherein each pivot steering box comprises trunnions pivoted to said frame within said cavities for supporting the rotor assembly and enabling pivoting.

16. The riding trowel of claim 14 further comprising pivot stop means for mechanically limiting pivoting.

17. The riding trowel of claim 14 wherein the frame is shaped like an isosceles triangle.

18. The riding trowel of claim 14 wherein the angle formed between the frame base and each side is approximately 30–50 degrees.

19. The riding trowel of claim 14 wherein the triangular frame has a base and an altitude, and the altitude length is approximately 40%–50% of the base length.

20. The riding trowel of claim 14 wherein the weights borne by the rear rotor assemblies are within 10%–15% of each other, and the front rotor assembly bears approximate 50%–70% of the weight of the trowel.

* * * * *